US005393636A

United States Patent [19]

Sugita et al.

[11] Patent Number: 5,393,636

[45] Date of Patent: Feb. 28, 1995

[54] PROCESS FOR PRODUCING TONER FOR THE DEVELOPMENT OF AN ELECTRIC IMAGE

[75] Inventors: Jun Sugita, Tenri; Kazushige Morita, Shiki; Satoshi Katayama, Nara; Hiroshi Sugimura, Habikino; Satoshi Nishigaki; Kazuhiro Emoto, both of Nara, all of Japan

[73] Assignee: Sharp Kabushiki Kaisha, Osaka, Japan

[21] Appl. No.: 255,895

[22] Filed: Jun. 7, 1994

Related U.S. Application Data

[63] Continuation of Ser. No. 992,750, Dec. 18, 1992, abandoned.

[30] Foreign Application Priority Data

Jan. 17, 1992 [JP] Japan ..... 4-025989

[51] Int. Cl.[6] ..... G03G 9/087

[52] U.S. Cl. ..... 430/137; 430/110

[58] Field of Search ..... 430/109, 110, 137

[56] References Cited

U.S. PATENT DOCUMENTS

| | | | |
|---|---|---|---|
| 5,219,943 | 6/1993 | Akasaki et al. | 525/253 |
| 5,219,947 | 6/1993 | Yasuda et al. | 430/109 |

FOREIGN PATENT DOCUMENTS

| | | |
|---|---|---|
| 57-114147 | 7/1982 | Japan . |
| 60-88003 | 5/1985 | Japan . |
| 63-178103 | 7/1988 | Japan . |
| 3-202855 | 9/1991 | Japan . |

*Primary Examiner*—John Goodrow

*Attorney, Agent, or Firm*—Nixon & Vanderhye

[57] ABSTRACT

The present invention provides a process for producing a practical toner for the development of an electrostatic image which has an effect of preventing an offset phenomenon and has low-temperature fixing properties. The process for producing a toner of the present invention comprises the steps of dissolving a high-molecular polymer in a vinyl monomer, mixing the resultant solution with another toner material, and then carrying out suspension polymerization. Preferable examples of the high-molecular polymer include a polymer having a structure unit represented by the formula

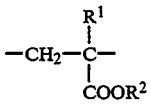

(1)

wherein $R^1$ is hydrogen or a methyl group, and $R^2$ is a straight-chain or branched alkyl group having 1 to 20 carbon atoms, and a polymer having a structure unit represented by the formula

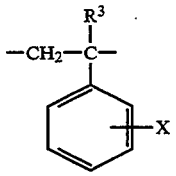

(2)

wherein $R^3$ is hydrogen or a methyl group, and X is hydrogen, a methyl group, a halogen atom or a methoxy group.

9 Claims, No Drawings

PROCESS FOR PRODUCING TONER FOR THE DEVELOPMENT OF AN ELECTRIC IMAGE

This is a continuation of application Ser. No. 07/992,750, filed Dec. 18, 1992, now abandoned.

BACKGROUND OF THE INVENTION (i) Field of the Invention

The present invention relates to a process for producing a toner for the development of an electrostatic image. More specifically, it relates to a process for producing a toner for the development of an electrostatic image which comprises subjecting a mixture of a high-molecular polymer, a pigment, a dye and a vinyl monomer to suspension polymerization.

(ii) Description of the Related Art

In electrostatic photography, fixing is carried out after an electrostatic image has been developed with a toner, but in general, a toner image is first obtained by developing an electrostatic image retained on a photoconductive photoreceptor or an electrostatic recorder, and the fixing is then carried out by transferring the thus obtained toner image from the photoconductive photoreceptor or the electrostatic recorder to a transfer sheet such as a paper, and then fusing the toner image thereon. In this case, the fusing of the toner image is usually accomplished by bringing the toner image into contact with a solvent vapor or by heating the toner image. In particular, a non-contact heating system using an electric furnace and a pressure heating system using a heating roller are usually employed.

In the pressure heating system using the heating roller, the surface of the heating roller comes in contact with the image on the sheet to be fixed under pressure, and so, in the case that the toner image is thermally fused on the sheet to be fixed, a thermal efficiency is high and the fixing can be carried out rapidly. Therefore, this pressure heating system is extremely suitable for an electrophotographic copying machine. In this system, however, the surface of the fixing roller comes into contact with the toner image in a heating/melting state under pressure, and hence a part of the toner image adheres to the surface of the fixing roller and is then transferred thereto. Then, this part is further transferred to the sheet to be fixed to bring about the so-called offset phenomenon, with the result that the sheet to be fixed is soiled sometimes. Accordingly, it is one of essential requirements for the heating roller fixing method to prevent the toner from adhering to the roller surface.

Japanese Patent Application Laid-open No. 60-88003 discloses a preparation method of a resin for a toner which comprises adding a high-molecular weight vinyl polymer emulsion to an aqueous medium containing a nonionic dispersant, and then subjecting the vinyl monomer to suspension polymerization. However, in the case that this resin is used for with the toner, there is a drawback that the nonionic dispersant remains in large quantities, which has a bad influence on electricity resistance.

Japanese Patent Application Laid-open No. 63-178103 discloses a preparation method of a resin for a toner which comprises subjecting a low-molecular weight vinyl polymer to suspension polymerization by the use of a dispersant selected from the group consisting of anionic and nonionic suspension polymerization dispersants in the presence of a high-molecular weight vinyl polymer emulsion in which an anionic water-soluble high-molecular suspension polymerization dispersant (I) is used as an emulsifying agent. However, in the case that this resin is used for the toner, there is a drawback that a fixing lower limit temperature is high. Thus, the toner having lower-temperature fixing properties is desired.

Furthermore, Japanese Patent Application Laid-open No. 59-14747 discloses a toner for the development of an electrostatic image which contains a suspension-polymerized material of styrene or the like as the main component, but in this case, a temperature at which an offset phenomenon occurs is low, which makes the toner impractical.

SUMMARY OF THE INVENTION

An object of the present invention is to solve the above-mentioned problems, i.e., to provide a process for producing a practical toner for the development of an electrostatic image which has an effect of preventing an offset phenomenon and has low-temperature fixing properties.

The present inventors have found that a toner obtained by dissolving a high-molecular polymer in a vinyl monomer, mixing the resultant solution with another toner material, and then subjecting the mixture to suspension polymerization is effective for the prevention of the offset phenomenon and the low-temperature fixing properties. On the basis of this knowledge, a process for producing a toner of the present invention has now been completed.

That is, a process for producing a toner of the present invention comprises the steps of dissolving a high-molecular polymer in a vinyl monomer, mixing the resultant solution with another toner material, and then carrying out suspension polymerization. Preferably the high-molecular polymer is exactly dissolved in the monomer, since the particle properties of the resulting toner fluctuate when the high-molecular polymer is not dissolved in the monomer.

No particular restriction is put on the high-molecular polymer which can be used in the preparation process of the present invention, so long as it can be dissolved in the vinyl monomer, but preferable examples of the high-molecular polymer include polymers having a structure unit represented by the formula

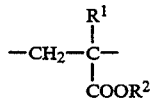

(1)

wherein $R^1$ is hydrogen or a methyl group, and $R^2$ is a straight-chain or branched alkyl group having 1 to 20 carbon atoms, and polymers having a structure unit represented by the formula

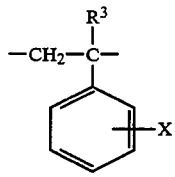

(2)

wherein $R^3$ is hydrogen or a methyl group, and X is hydrogen, a methyl group, a halogen atom or a methoxy group.

The molecular weight of the high-molecular polymer is usually 10,000 or more. Furthermore, the amount of the high-molecular polymer is in the range of 5 to 50% by weight based on the total weight of the vinyl monomer and the high-molecular polymer.

DETAILED DESCRIPTION OF PREFERRED EMBODIMENTS

A preparation process of the present invention is characterized by comprising the steps of dissolving a high-molecular polymer in a vinyl monomer, mixing the resultant solution with another toner material, and then subjecting the mixed solution to suspension polymerization, but the main constitutional component is a polymeric composition obtained from the above-mentioned solution.

The high-molecular polymer which is used in the present invention may be any one of a homopolymer, a copolymer of two kinds of monomers and a mixed polymer obtained by suitably mixing the homopolymer and the copolymer.

Examples of the polymer containing the structure unit represented by the formula (1) include homopolymers of compounds mentioned in the following paragraph (a), copolymers of these compounds, and copolymers of these compounds and other vinyl monomers.

(a) Vinyl carboxylic acids such as acrylic acid and methacrylic acid, and vinyl monocarboxylates such as methyl acrylate, ethyl acrylate, n-butyl acrylate, isobutyl acrylate, n-octyl acrylate, 2-ethylhexyl acrylate, chloroethyl acrylate, methyl methacrylate, ethyl methacrylate, n-butyl methacrylate, isobutyl methacrylate, n-octyl methacrylate, dodecyl methacrylate and steary methacrylate.

Examples of the polymer containing the structure unit represented by the formula (2) include homopolymers of compounds mentioned in the following paragraph (b), copolymers of these compounds, and copolymers of these compounds and other vinyl monomers.

(b) Styrenes such as styrene, o-, m- and p-methylstyrenes, α-methylstyrene, p-ethylstyrene, p-tert-butylstyrene, 2,4-dimethylstyrene, p-n-butylstyrene, p-n-hexylstyrene, p-n-octylstyrene, p-n-nonylstyrene, p-n-decylstyrene, p-n-dodecylstyrene, p-phenylstyrene, p-chlorostyrene, p-methoxystyrene and 3,4-dichlorostyrene.

The molecular weight of the high-molecular polymer is usually 10,000 or more. Furthermore, the amount of the high-molecular polymer is in the range of 5 to 50% by weight based on the total weight of the vinyl monomer and the high-molecular polymer.

In the preparation method of the present invention, examples of the vinyl monomer in which the high-molecular weight polymer is dissolved include the following compounds:

Styrenes such as styrene, o-, m- and p-methylstyrenes, α-methylstyrene, p-ethylstyrene, p-tert-butylstyrene, 2,4-dimethylstyrene, p-n-butylstyrene, p-n-hexylstyrene, p-n-octylstyrene, p-n-nonylstyrene, p-n-decylstyrene, p-n-dodecylstyrene, p-phenylstyrene, p-chlorostyrene, p-methoxystyrene and 3,4-dichlorostyrene; vinylnaphthalenes; olefins such as ethylene, propylene, butylene and isobutylene; vinyl halides such as vinyl chloride and vinyl fluoride; and vinyl esters such as vinyl acetate and vinyl butyrate; vinylcarboxylic acids such as acrylic acid and methacrylic acid; vinyl monocarboxylates such as methyl acrylate, ethyl acrylate, n-butyl acrylate, isobutyl acrylate, n-octyl acrylate, 2-ethylhexyl acrylate, chloroethyl acrylate, methyl methacrylate, ethyl methacrylate, n-butyl methacrylate, isobutyl methacrylate, n-octyl methacrylate, dodecyl methacrylate and stearyl methacrylate; acrylonitriles such as acrylonitrile and methacrylonitrile; vinyl amides such as acrylamide and methacrylamide; vinyl ethers such as vinyl methyl ether, vinyl ethyl ether and vinyl isobutyl ether; ethylenic dicarboxylic acids such as dimethyl maleate, diethyl maleate and dibutyl maleate and their derivatives; vinyl ketones such as vinyl methyl ketone and vinyl hexyl ketone; vinylidene halides such as vinylidene chloride and vinylidene chlorofluoride; and vinyl-substituted heterocyclic compounds such as vinylpyrrole, vinylcarbazole, vinylindole and vinylpyrrolidone. Of these vinyl monomers, styrene, o-, m- and p-methylstyrenes, acrylates, methacrylates and vinyl acetate are particularly preferable.

The above-mentioned monomers may be used singly or in a combination of two or more thereof. In the case that two or more of these monomers are used in combination, it is preferable that the two or more monomers are compatible with each other, and no particular restriction is put on a mixing ratio of these monomers. The mixing ratio depends upon a performance required for the toner regarding the preparation process of the present invention.

The vinyl monomer and the monomer component of the high-molecular polymer which are used in the preparation process of the present invention are not always identical, and different kinds of monomers may be combined in compliance with characteristics required for the toner. The amount of the vinyl monomer to be used is in the range of 95 to 50% by weight based on the total weight of a mixture of the vinyl monomer and the high-molecular-polymer.

The following combinations of the high-molecular polymer and the vinyl monomer are preferably used in the present invention.

The high-molecular polymer comprise at least one selected from the group consisting of homopolymers and copolymers of methyl acrylate, ethyl acrylate, n-butyl acrylate, 2-ethylhexyl acrylate, methyl methacrylate, ethyl methacrylate and n-butyl methacrylate.

The vinyl monomers comprise at least one selected from the group consisting of styrene, methyl acrylate, ethyl acrylate, n-butyl acrylate, 2-ethylhexyl acrylate, methyl methacrylate, ethyl methacrylate and n-butyl methacrylate.

When the amount of the vinyl monomer is more than 95% by weight, effects of the present invention cannot be obtained, and when it is less than 50% by weight, the high-molecular polymer is not dissolved in the monomer, so that the toner having a necessary particle diameter cannot be obtained inconveniently.

Examples of the other toner materials which are used in the preparation method of the present invention include a colorant, a plasticizer, an charge control agent, a mold release agent, additives and the like.

The colorant is a pigment or a dye. Examples of the colorant include black pigments such as carbon black, Nigrosine, oil black, azo oil black, lamp black (C. I. No. 77266), aniline black and iron black; blue pigments such as chalco-oil blue (azoec Blue 3), aniline blue (C. I. No. 50405), ultramarine blue (C. I. No. 77103), methylene blue chloride (C. I. No. 52015), phthalocyanine blue (C. I. No. 74160), prussian blue, cobalt blue, alkali blue lake and fast sky blue; yellow pigments such as chrome yellow (C. I. No. 14090), Quinoline Yellow (C. I. No. 47005), yellow lead, mineral fast yellow, Hansa Yellow G, Benzidine Yellow G and Permanent Yellow NCG; red pigments such as Rose Bengal (C. I. No. 45435), Du Pont Oil Red (C. I. No. 26105), Orient Oil Red +330 (C. I. No. 60505), Permanent Red 4R, Brilliant Carmine 6B, Alizarine Lake, red lead and red iron oxide; orange pigments such as Permanent Orange GRT, Hydrazone Orange, Vulcan Orange, Benzidine Orange G, Indanthrene Brilliant Orange GK, Molybdenum Orange and chrome orange; green pigments such as Malachite Green oxalate (C. I. No. 42000), Chrome Green, Pigment Green B and Fanal Yellow Green G; violet pigments such as manganese violet, Fast Violet B and methyl violet lake; and white pigments such as titanium oxide and antimony white. The colorant is required to be contained in a ratio enough to form a visible image, and the amount of the colorant is preferably in the range of 1 to 20 parts by weight based on 100 parts by weight of the total of the high-molecular polymer and the vinyl monomer.

An example of the plasticizer is butyl stearate.

Examples of the charge control agent include oil-soluble dyes such as Nigrosine, oil black and spilon black, metal salts of naphthenic acid, fatty metallic soaps, resin acid soaps and quaternary ammonium salts. In general, the amount of the charge control agent is preferably in the range of 0.3 to 10 parts by weight based on 100 parts by weight of the total of the high-molecular polymer and the vinyl monomer.

The additive is that which comprises a component by which physical properties and developing properties of the toner can be regulated, and an example of the additive is a hydrophobic silica.

In order to provide the toner with fixing properties, some of a low-molecular weight polyethylene, a low-molecular weight polypropylene, various waxes and silicone oil can be used.

The suspension polymerization in the preparation process of the present invention can be carried out by mixing a solution, which is obtained by dissolving the above-mentioned high-molecular polymer in the vinyl monomer, with another toner material. In this case, however, a radical polymerization initiator, a suspension stabilizer and a surface active agent are used, and the polymerization is performed in an aqueous medium. Furthermore, when a gaseous material at ordinary temperature such as ethylene, propylene or vinyl chloride is used, the dissolution and the suspension polymerization are carried out under pressure.

The amount of the aqueous medium is in the range of 80 to 500 parts by weight, preferably 100 to 200 parts by weight based on 100 parts by weight of the obtained polymer grains. When this amount is less than 80 parts by weight, it is difficult to stably keep the disperse system, and when it is more than 500 parts by weight, productivity is unpreferably poor.

The suspension polymerization of the present invention is not peculiar, and it can be carried out in a usual manner. For example, the polymerization can be easily achieved by adding toner materials such as predetermined amounts of the high-molecular polymer and the vinyl monomer and a suitable amount of the polymerization initiator to the aqueous medium in which the anionic dispersant is dissolved, and then continuously stirring and heating the mixture.

Examples of the radical polymerization initiator include organic peroxides such as benzoyl peroxide, lauroyl peroxide, tert-peroxy-2-ethyl hexanoate, acetyl peroxide and t-butyl perbenzoate; and azo compounds such as azobisisobutyronitrile and 2,2'-azobis-2,4-dimethylvaleronitrile. In certain cases, inorganic polymerization initiators such as sodium persulfate and potassium persulfate can also be used. The amount of the polymerization initiator is in the range of 0.1 to 10 parts by weight based on 100 parts by weight of the vinyl monomer.

As the suspension/dispersion stabilizer, an anionic surface active agent can be advantageously used. Typical examples of the stabilizer include salts of fatty acids such as sodium oleate and castor oil potassium soap; sulfates of higher alcohols such as sodium lauryl sulfate and sodium cetylsulfate; an alkylallyl sulfonate such as sodium dodecylbenzenesulfonate; sodium alkylnaphthalenesulfonate, sodium salts of a formalin $\beta$-naphthalinesulfonate condensate, derivatives of naphthaline sulfonates, dialkyl sulfosuccinates, dialkyl phosphates, polyoxyethylene alkyl ether sulfates, triethanolamine polyoxyethylene alkyl ether sulfates and polyoxyethylene alkylphenol ether sulfates. The amount of the anionic surface active agent is in the range of 0.1 to 5 parts by weight, preferably 0.4 to 2 parts by weight based on 100 parts by weight of the vinyl monomer.

As the suspension/dispersion stabilizer, a water-insoluble inorganic powder may be used in a combination of the above-mentioned surface active agent. With regard to this inorganic powder, a particle diameter of 0.01 to 5 $\mu$m is advantageous. Examples of the inorganic powder include tricalcium phosphate, talc, bentonite, kaolin, titanium oxide, alumina, aluminum hydroxide, magnesium hydroxide, basic magnesium silicate, titanium hydroxide, ferric hydroxide, barium sulfate, silica, magnesium carbonate and calcium carbonate. The amount of the dispersion stabilizer to be used is preferably in the range of 1 to 20 parts based on 100 parts by weight of water. When this amount is less than 1 part by weight, the effect of the dispersion stabilizer is insufficient, and when it is more than 20 parts by weight, the dispersion stability conversely worsens.

The suspension polymerization in the preparation process of the present invention is different from a usual polymerization owing to the presence of the high-molecular polymer dissolved in the monomer and the other mixed toner. It can be presumed that in a polymerization reaction, the suspension polymer of the vinyl monomer twines together with the high-molecular polymer and the toner material and a reaction of the high-molecular polymer with the toner material partially takes place, so that a complex polymer composition is formed. Thus, the resultant toner blend is different from a simple mixture of the polymer and the toner material, and it can be supposed that the respective components of the toner blend come in close contact with one another to exert an excellent offset prevention effect.

According the preparation process of the present invention, a practical toner for the development of an electrostatic image can be obtained by which the offset phenomenon can be prevented and which has a low-temperature fixing properties.

Furthermore, the toner can prevent a fixing roller and a sheet to be fixed from soiling, because an offset phenomenon occurrence temperature of the toner is higher than in a conventional case. In addition, a minimum fixing temperature of the toner is low, and therefore the toner has an advantage that a consumption of electric power and a warming-up time of a copying machine can be reduced.

EXAMPLES

The present invention will be described in more detail in reference to examples, but the scope of the present invention should not be limited to these examples. In the following examples, "part" and "parts" by which an amount of each component is represented mean "part by weight" and "parts by weight".

Toners obtained in examples and comparative examples were evaluated in the following manner.

5.5 parts of an obtained toner were mixed with 94.5 parts of a ferrite-based carrier to prepare a developing agent, and an electrostatic image formed in accordance with a usual electrophotography by the use of an electrophotographic copying machine (SF-8800, made by Sharp Corp.) was then developed with the prepared developing agent. Next, the resultant toner image was transferred onto a paper, and the following characteristics were then evaluated.

(1) A fixing lower limit temperature and an offset generation temperature

The transfer paper, on which the toner image was formed, was passed through between a fixing roll having a surface made of Teflon and a pressure roll having a surface made of silicone rubber. A fixing lower limit temperature and an offset generation temperature were measured by fixing the toner image, temperatures of the fixing roll being variously changed.

(2) Evaluation of offset properties

The transfer paper, on which the toner image was formed, was passed through between a fixing roll having a surface made of Teflon and a pressure roll having a surface made of silicone rubber. Next, in order to inspect whether or not a fused toner image was formed, after a fixing operation, a transfer paper having no toner image was passed through between the pressure rolls, and a soil due to an offset of the toner on the transfer paper was observed. At this time, a temperature of the fixing roll was 170° C.

Example 1

30 parts of polystyrene having an average molecular weight of $2.0\times10^5$ as a high-molecular polymer were dissolved in a mixture of 45 parts of styrene and 25 parts of n-butyl methacrylate (hereinafter referred to as "BMA"), and to the resultant solution were added 7 parts of carbon black ("MA-100" made by MITSUBISHI KASEI CORPORATION), 5 parts of 2,2'-azobis-2,4-dimethylvaleronitrile, 1 part of an charge control agent (Nigrosine N-04; made by ORIENT CHEMICAL CO., LTD.) and 2 parts of a low-molecular weight polypropylene wax ("Viscol 550P" made by SANYO CHEMICAL INDUSTRIES, LTD.). The mixture was placed in a flask in which a mixture of 500 parts of water, 15 parts of tricalcium phosphate and 0.05 part of sodium lauryl sulfate was present, and the solution was then stirred for 10 minutes at 5000 rpm, followed by stirring at 60° C. for 9 hours to carry out suspension polymerization. After the polymerization, the solution was subjected to an acid treatment and then washed with water to obtain a toner of an average particle diameter of 10.4 μm. The results are set forth in Table 1.

Example 2

20 parts of polybutyl methacrylate having an average molecular weight of $1.8\times10^5$ as a high-molecular polymer were dissolved in a mixture of 70 parts of styrene and 10 parts of BMA, and to the resultant solution were added 7 parts of carbon black ("MA-100" made by MITSUBISHI KASEI CORPORATION), 3 parts of 2,2'-azobis-2,4-dimethylvaleronitrile, 1 part of an charge control agent (Nigrosine N-04; made by ORIENT CHEMICAL CO., LTD.) and 2 parts of a low-molecular weight polypropylene wax ("Viscol 550P" made by SANYO CHEMICAL INDUSTRIES, LTD.). The mixture was placed in a flask in which a mixture of 500 parts of water, 15 parts of tricalcium phosphate and 0.05 part of sodium lauryl sulfate was present, and the solution was then stirred for 10 minutes at 5000 rpm, followed by stirring at 60° C. for 9 hours to carry out suspension polymerization. After the polymerization, the solution was subjected to an acid treatment and then washed with water to obtain a toner of an average particle diameter of 10.6 μm. The results are set forth in Table 1.

Comparative Example 1

Any high-molecular polymer was not used. To a mixture of 75 parts of styrene and 25 parts of BMA were added 7 parts of carbon black ("MA-100" made by MITSUBISHI KASEI CORPORATION), 5 parts of 2,2'-azobis-2,4-dimethylvaleronitrile, 1 part of an antistatic agent (Nigrosine N-04; made by ORIENT CHEMICAL CO., LTD.) and 2 parts of a low-molecular weight polypropylene wax ("Viscol 550P" made by SANYO CHEMICAL INDUSTRIES, LTD.). The mixture was placed in a flask in which a mixture of 500 parts of water, 15 parts of tricalcium phosphate and 0.05 part of sodium lauryl sulfate was present, and the solution was then stirred for 10 minutes at 5000 rpm. Afterward, the solution was placed in a flask, and suspension polymerization was performed at 60° C. for 9 hours. After the polymerization, the solution was subjected to an acid treatment and then washed with water to obtain a toner of an average particle diameter of 10.5 μm. The results are set forth in Table 1.

TABLE 1

| | Example 1 | Example 2 | Comparative Example 1 |
|---|---|---|---|
| High-molecular Polymer: | | | |
| Average Molecular Weight | $2.0\times10^5$ | $1.8\times10^5$ | $6.5\times10^4$ |
| Glass Transition Point | 63° C. | 60° C. | 61° C. |
| Properties of Toner: | | | |
| Minimum Fixing Temp. | 130° C. | 125° C. | 135° C. |
| Offset Generation Temp. | 210° C. | 215° C. | 195° C. |
| Offset Properties | Practical | Practical | Narrowly practical |

Comparative Example 2

0.4 part of azobisisobutyronitrile (AIBN) as a polymerization initiator was added to 40 parts of styrene, and the resultant mixture, 150 parts of water, 4.5 parts of tricalcium phosphate and 0.01 part of sodium lauryl sulfate were then dispersed for 10 minutes at 5000 rpm. The solution was placed in a flask equipped with a rotating stirring blade, and polymerization was then arried out at 75° C. for 8 hours. After the polymerization, the solution was subjected to an acid treatment and then washed with water to obtain a high-molecular polymer.

30 parts of this high-molecular polymer were dissolved in a mixture of 50 parts of styrene and 20 parts of n-BMA, and to the solution was added a mixture of 5 parts of 2,2'-azobis-2,4-dimethylvaleronitrile, 500 parts of water, 15 parts of tricalcium phosphate and 0.05 part of sodium lauryl sulfate. Next, the solution was stirred for 10 minutes at 5000 rpm, and then placed in the flask equipped with the rotating stirring blade, and suspension polymerization was then carried out at 60° C for 9 hours. After the polymerization, to the solution was added 7 parts of carbon black ("MA-100" made by MITSUBISHI KASEI CORPORATION), 1 part of an charge control agent (Nigrosine N-04; made by ORIENT CHEMICAL CO., LTD.) and 2 parts of a low-molecular weight polypropylene wax ("Viscol 550P" made by SANYO CHEMICAL INDUSTRIES, LTD.), followed by stirring. Afterward, in order to eliminate a suspension state, the solution was subjected to an acid treatment and then washed with water, but any toner particles could not be obtained.

Comparative Example 3

(Preparation of high-molecular polymer emulsion)

0.4 part of dinonyl sodium sulfosuccinate [$NaSO_3$—$CH(CH_2COOC_9H_7)(COOC_9H_7)$], 0.04 part of $K_2S_2O_8$ and 60 parts of distilled water were placed in a 1-liter separable flask and then dissolved. Next, a mixed monomer of 32 parts of styrene and 8 parts of BMA was added thereto dropwise over 3 hours to carry out polymerization, while the temperature in the flask was maintained at 80° C. Afterward, the temperature was raised up to 90° C. and then maintained for 1 hour to complete the polymerization. A solid content in the obtained polymer emulsion was 41.3%, and a weight-average molecular weight of the polymer was $76.5\times10^4$.

(Preparation of toner)

0.6 part of a nonionic dispersant (GOHSENOL GH-23; made by The Nippon Synthetic Chemical Industry Co., Ltd.; partially saponified PVA having a saponification value of 86.5% and a polymerization degree of 2300) was placed in a 1-liter separable flask and then dissolved in 150 parts of distilled water. Next, 25 parts of the above-mentioned emulsion were added thereto, and to the solution were further added 60 parts of styrene, 15 parts of BMA, 7 parts of carbon black ("MA-100" made by MITSUBISHI KASEI CORPORATION), 3 parts of 2,2'-azobis-2,4-dimethylvaleronitrile, 1 part of an charge control agent (Nigrosine N-04; made by ORIENT CHEMICAL CO., LTD.) and 2 parts of a low-molecular weight polypropylene wax ("Viscol 550P" made by SANYO CHEMICAL INDUSTRIES, LTD.), and they were then dispersed.

The temperature in the flask was maintained at 60° C. for 5 hours to achieve suspension polymerization. However, the dispersion was not successfully carried out, so that any uniform toner particles could not be obtained.

What we claim is:

1. A process for producing a toner for the development of an electrostatic image which comprises the steps of dissolving a high-molecular polymer in a vinyl monomer, mixing the resultant solution with a polymerization initiator and a toner material comprising a colorant and an charge control agent, and then carrying out suspension polymerization.

2. The process for producing a toner for the development of an electrostatic image according to claim 1 wherein the high-molecular polymer comprises a polymer having a structure unit represented by the formula

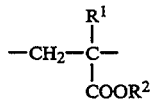

(1)

wherein $R^1$ is hydrogen or a methyl group, and $R^2$ is a straight-chain or branched alkyl group having 1 to 20 carbon atoms.

3. The process for producing a toner for the development of an electrostatic image according to claim 1 wherein the high-molecular polymer comprises a polymer having a structure unit represented by the formula

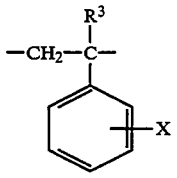

(2)

wherein $R^3$ is hydrogen or a methyl group, and X is hydrogen, a methyl group, a halogen atom or a methoxy group.

4. The process for producing a toner for the development of an electrostatic image according to claim 1 wherein the amount of the high-molecular polymer is in the range of 5 to 50% by weight based on the total weight of the vinyl monomer and the high-molecular polymer.

5. The process for producing a toner for the development of an electrostatic image according to claim 1 wherein the high-molecular polymer comprises at least one selected from the group consisting of homopolymers and copolymers of methyl acrylate, methyl methacrylate, ethyl methacrylate and n-butyl methacrylate and the vinyl monomers comprise at least one selected from the group consisting of styrene, methyl acrylate, ethyl acrylate, n-butyl acrylate, 2-ethylhexyl acrylate, methyl methacrylate, ethyl methacrylate and n-butyl methacrylate.

6. The process for producing a toner for the development of an electrostatic image according to claim 1 wherein 1 to 20 parts by weight of the colorant and 0.3 to 10 parts by weight of the charge control agent based on 100 parts by weight of the total of the vinyl monomer and the high-molecular polymer.

7. The process for producing a toner for the development of an electrostatic image which comprises the steps of dissolving a high-molecular polymer in a vinyl monomer, mixing the resulting solution with a polymerization initiator and a toner material consisting essentially of a colorant and an charge control agent, and then carrying out suspension polymerization in an aqueous medium to which a solution obtained by the above mixing is added.

8. The process for producing a toner for the development of an electrostatic image according to claim 7 wherein the amount of the high-molecular polymer is in the range of 5 to 50% by weight based on the total weight of the vinyl monomer and the high-molecular polymer.

9. The process for producing a toner for the development of an electrostatic image according to claim 7 wherein the amount of the aqueous medium is in the range of 80 to 500 parts by weight based on 100 parts by weight of the obtained polymer grains.

* * * * *